United States Patent [19]

McDonie et al.

[11] Patent Number: 4,570,102

[45] Date of Patent: Feb. 11, 1986

[54] PHOTOMULTIPLIER TUBE HAVING AN ELECTRON MULTIPLIER CAGE ASSEMBLY WITH UNIFORM TRANSVERSE SPACING

[75] Inventors: Arthur F. McDonie; Donald B. Kaiser, both of Lancaster, Pa.

[73] Assignee: RCA Corporation, Princeton, N.J.

[21] Appl. No.: 611,753

[22] Filed: May 18, 1984

[51] Int. Cl.[4] ..... H01J 40/04; H01J 43/26; H01J 19/42

[52] U.S. Cl. ..... 313/533; 313/536; 313/261

[58] Field of Search ..... 313/536, 533, 532, 535, 313/261

[56] References Cited

U.S. PATENT DOCUMENTS

| | | | |
|---|---|---|---|
| Re. 30,249 | 4/1980 | Faulkner | 313/104 |
| 2,200,722 | 5/1940 | Pierce et al. . | |
| 2,862,135 | 11/1958 | Payne | 313/261 X |
| 3,119,037 | 1/1964 | Stanley . | |
| 3,873,867 | 3/1975 | Girvin . | |
| 4,125,793 | 11/1978 | Timan . | |
| 4,184,098 | 1/1980 | Morales . | |
| 4,370,585 | 1/1983 | Butterwick . | |
| 4,431,943 | 2/1984 | Faulkner et al. | 313/533 |
| 4,446,401 | 5/1984 | Faulkner et al. | 313/533 |

OTHER PUBLICATIONS

U.S. patent application entitled, "Electrode Structure for an Electron Multiplier Cage Assembly", by D. B. Kaiser, filed concurrently herewith—Ser. No. 611,754.

U.S. patent application entitled, "Shield Cup to Cage Assembly Connecting Tab Member", by A. F. McDonie et al., filed concurrently herewith—Ser. No. 611,873.

U.S. patent application entitled, "Photomultiplier Tube Having an Improved Centering and Cathode Contacting Structure", by D. B. Kaiser, filed concurrently herewith—Ser. No. 611,958.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having a photoemissive cathode, a shield cup spaced from the cathode and an electron multiplier cage assembly abutting the shield cup. The cage assembly includes a pair of transversely spaced support plates having a plurality of support slots formed therethrough. Each of the support plates has a distal end and a proximal end, with the proximal ends being attached to the shield cup. A light shield is disposed between the distal end of the support plates. An anode and a plurality of dynodes, at least one of which has a field mesh attached thereto, are disposed between the support plates and attached thereto by end tabs. The end tabs extend from the side of the anode and the dynodes. The aforementioned shield cup includes flaps which establish a minimum transverse spacing between the proximal ends of the support plates. The light shield has a transverse dimension substantially equal to that of the flaps to establish a minimum transverse spacing between the distal end of the support plates. The flaps and the light shield thus act, in combination, to provide a uniform minimum transverse spacing between the support plates which is greater than the transverse dimension of the anode and the dynodes to prevent distortion of the field mesh. The tab ends of the dynode and the anode are bifurcated so that one portion of selected ones of the tab ends can be formed to secure the dynodes and the anode between the support plates.

8 Claims, 4 Drawing Figures

PHOTOMULTIPLIER TUBE HAVING AN ELECTRON MULTIPLIER CAGE ASSEMBLY WITH UNIFORM TRANSVERSE SPACING

BACKGROUND OF THE INVENTION

The present invention relates to photomultiplier tubes and, more particularly, to a photomultiplier tube in which uniform transverse spacing is provided in the electron multiplier cage assembly to prevent distortion of the elements comprising the cage assembly.

In the manufacturing of a high volume photomultiplier tube, conflicting objectives are frequently encountered. The tube must be designed to provide accurate and reproducible measurement of the phenomenon being observed, and yet the tube must be inexpensive to produce. The former objectives demand that the position of each element of the tube be fixed accurately with respect to the other tube elements; however, this must be done without the use of a large number of expensive precision parts. In order to achieve the latter objective, the tube must be easy to assemble in order to eliminate the need for difficult, time consuming assembly techniques.

In one type of photomultiplier tube, the electrodes of an electron multiplier are supported on metal brackets having arms which protrude transversely through large apertures formed in parallel insulating spacers disposed on either end of the electrodes. Electrical leads are welded to the metal brackets and to the free ends of some of the auxiliary electrodes. Others of the auxiliary electrodes have mechanical stops welded thereto. The brackets maintain the integrity of the electron multiplier. One such structure of this type having an inline electron multiplier is shown in U.S. Pat. No. 2,200,722, issued to Pierce et al. on May 14, 1940. The Pierce et al. structure is complex, labor intensive and, thereore, expensive to manufacture.

U.S. Pat. No. 4,125,793, issued to Timan on Nov. 14, 1978, discloses a photomultiplier tube having a box and grid dynode structure with a floating anode that is not supported by the insulating side supports which rigidly hold the dynodes in fixed spatial relation. The purpose of the floating anode is to isolate the anode from the side supports which are disclosed to carry ohmic leakage or leakage currents. There is no disclosure concerning the manner in which the dynodes are affixed to the side supports.

It has been found that in an electron multiplier structure, such as that disclosed in the Timan patent, in which a dynode mesh extends across one or more of the dynodes, transverse pressure exerted by the insulating side supports frequently deforms the dynode mesh to the point where the mesh alters the electrostatic field of the dynode causing a decrease in tube performance. Severe distortion of the mesh may even result in the mesh contacting an adjacent electrode causing an electrical short.

It is therefore desirable to provide a means for establishing a uniform minimum spacing between the insulating supports which support the dynodes and the anode of the electron multiplier so that there will be no deformation of the elements comprising the electron multiplier.

SUMMARY OF THE INVENTION

A photomultiplier tube comprises an evacuated envelope having therein a photoemissive cathode, a shield cup spaced from the cathode and an electron multiplier cage assembly abutting the shield cup. The cage assembly includes a pair of transversely spaced insulating support plates having a plurality of support slots formed therethrough. Each of the support plates has a distal end and a proximal end, with the proximal ends being attached to the shield cup. A light shield is disposed between the distal ends of the support plates. An anode and a plurality of dynodes, at least one of which has a field mesh attached thereto, are disposed between the support plates and attached thereto by oppositely projecting attachment means extending from the sides of the anode and the dynodes. The aforementioned shield cup includes support plate spacing means which establishes a minimum transverse spacing between the proximal ends of the support plates. The light shield has a transverse dimension substantially equal to that of the spacing means to establish the minimum transverse spacing between the distal ends of the support plates. The spacing means and the light shield thus act in combination, to provide a uniform minimum transverse spacing between the support plates, which is greater than the transverse dimension of the anode and the dynodes, to prevent distortion of the field mesh. The attachment means of the dynodes and the anode are bifurcated so that one portion of selected ones of the attachment means can be formed to secure the dynodes and the anode between the support plates.

DETAILED DESCRIPTION OF THE PREFERRED EMBODIMENT

Figure 1:
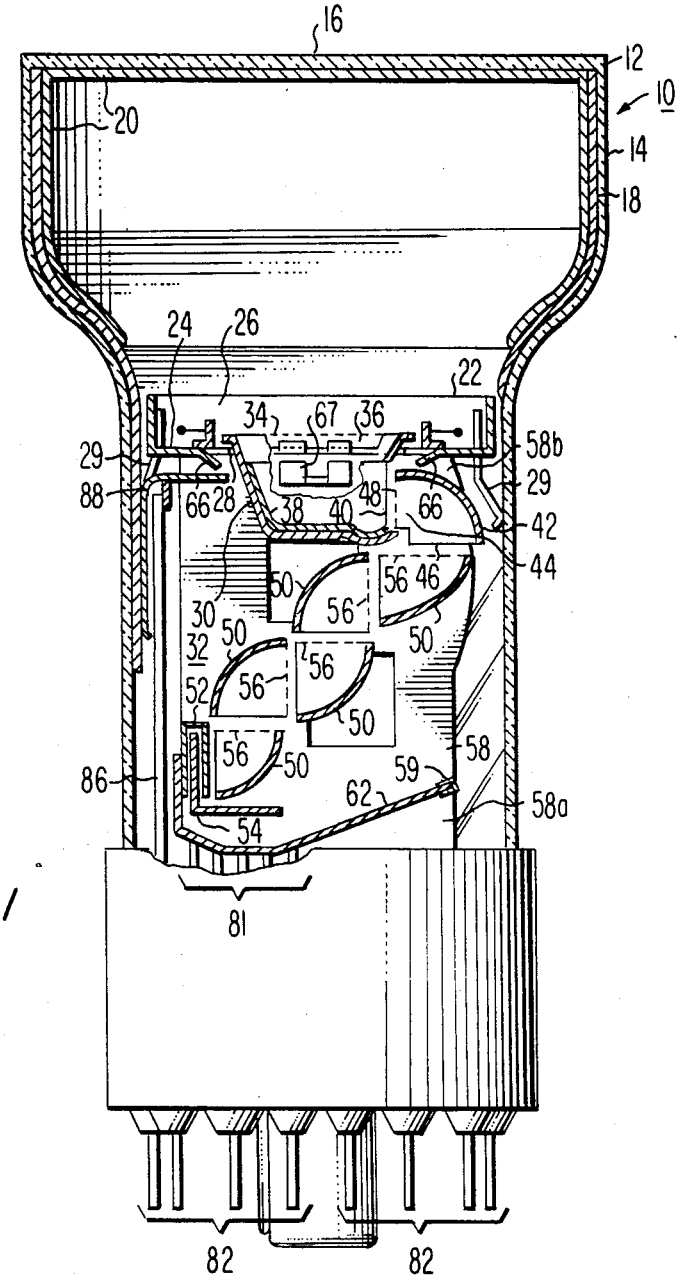
FIG. 1 is a partially broken away sectional view of a photomultiplier tube embodying the present invention.

A photomultiplier tube 10, shown in FIG. 1, comprises an evacuated envelope 12 having a sidewall 14. The envelope 12 is closed at one end by a transparent faceplate 16 and at the other end by a stem portion (not shown). A conductive layer 18 is vapor deposited on a portion of the sidewall 14 adjacent to the faceplate 16. A photoemissive cathode 20 is formed on the interior surface of the faceplate 16 and also along a portion of the conductive layer 18 on the sidewall 14. The photoemissive cathode 20 may comprise any of the alkali-antimonide materials known in the art, although a potassium-cesium antimonide cathode is preferred. The photoemissive cathode 20 emits photoelectrons in response to radiation incident thereon.

A shield cup 22 is provided in spaced relation to the photoemissive cathode 20. The shield cup 22 is a cup-shaped field forming electrode having a substantially flat base portion 24 and an annular wall portion 26 disposed perpendicular to the base portion 24. A centrally disposed, substantially rectangular aperture 28 extends through the base portion 24 of the shield cup 22. The shield cup 22 is centered within the envelope 12 by a plurality of bulb spacers 29. A primary dynode 30 is disposed within the aperture 28 and is spaced therefrom. The primary dynode 30 has a cross-sectional contour substantially identical to that described in U.S. Pat. No.

Re. 30,249, issued to R. D. Faulkner on Apr. 1, 1980, and comprises the first electrode of an electron multiplier cage assembly 32. A substantially flat primary field mesh member 34 is affixed to an input aperture 36 of the primary dynode 30. The primary dynode 30 preferably comprises a nickel substrate with an alkali-antimonide secondary emission coating 38 formed thereon. Alternatively, the primary dynode may be formed of a beryllium-copper material having a beryllium-oxide secondary emissive surface. The primary dynode 30 has an output aperture 40.

The electron multiplier cage assembly 32 further includes a box-like secondary dynode 42 which acts as a receiving member for secondary electrons emitted from the secondary emission coating 38 of the primary dynode 30. The dynode 42 has an input end 44 and an output end 46. A secondary field mesh member 48 extends across the input end of the secondary dynode 42. A plurality of additional substantially-identical box-like secondary dynodes 50 are disposed between the secondary dynode 42 and an ultimate secondary dynode 52. The ultimate secondary dynode 52 encloses an anode 54. Each of the secondary dynodes 42, 50 and 52 is preferably formed of nickel and has an alkali-antimonide coating (not shown) formed on the inside surface thereof so that the dynode can propagate electron emission from the cathode 20 to the anode 54. Each of the secondary dynodes 50 includes a field mesh 56 disposed across the input end thereof. The primary dynode 30, the secondary dynodes 42, 50, 52 and the anode 54 are disposed between a pair of substantially parallel, transversely spaced apart insulating support plates 58 (only one of which is shown in FIG. 1). The support plates 58 have a distal end 58*a* and a proximal end 58*b*. As shown in FIGS. 1 and 3, a shield notch 59 is formed along one side of each of the support plates 58 to accommodate a shield tab 60 (shown in FIG. 3) of a light shield 62 which extends transversely between the support plates 58 and closes the lower end of the cage assembly 32. The light shield 62 includes a pair of weld tabs 64, shown in FIGS. 2 and 3, which facilitate attachment of the light shield 62 to the ultimate dynode 52.

Figure 2:
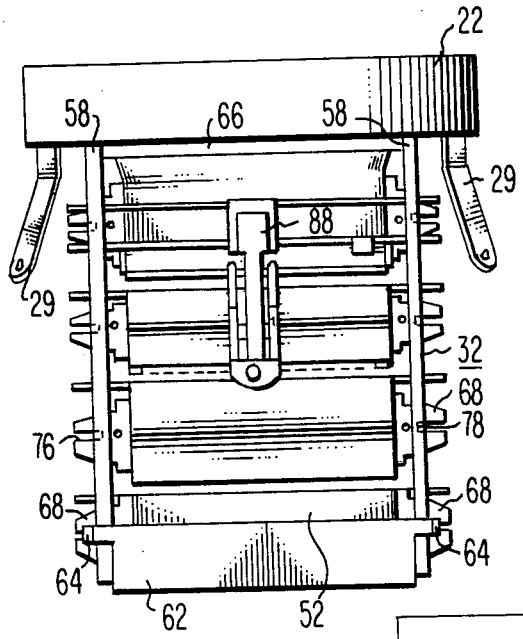
FIG. 2 is a side view of an electron multiplier cage assembly and shield cup.
Figure 3:
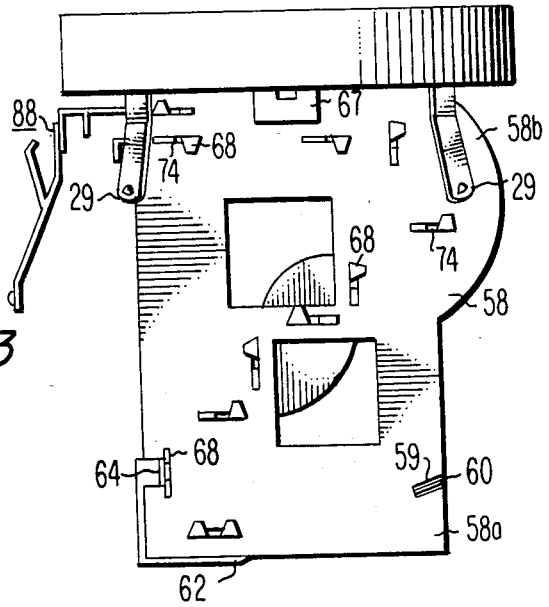
FIG. 3 is a front view of an electron multiplier cage assembly and shield cup.

As shown in FIGS. 1 and 2, support plate spacing means, comprising a plurality of flaps 66, are struck from the body of the shield cup 22 by slitting the base portion 24 adjacent to the centrally disposed aperture 28. The flaps 66 are bent downwardly at an angle of about 30 degrees, with respect to the base portion 24, so that they extend into the space between the proximal ends 58*b* of the support plates 58, where the plates 58 abut and are attached to the shield cup 22 by connecting tab members 67. Preferably, only two flaps 66 are provided, one on each of two oppositely disposed sides of the aperture 28. Each of the flaps 66 has a minimum width that is slightly greater than the transverse dimension or width of the secondary dynodes 42, 50, 52 and the anode 54, as disclosed in the copending U.S. patent application Ser. No. 611,754, filed concurrently herewith, by D. B. Kaiser entitled, ELECTRODE STRUCTURE FOR AN ELECTRODE MULTIPLIER CAGE ASSEMBLY. The minimum transverse dimension of the portion of the light shield 62 disposed between the distal ends 58*a* support plates 58 is designed to be equal to that of the flaps 66, so that the flaps 66 and the light shield 62, in combination, provide a uniform minimum transverse spacing between the pair of support plates 58 which is greater than the transverse dimension of the secondary dynodes 42, 50, 52 and of the anode 54.

Figure 4:
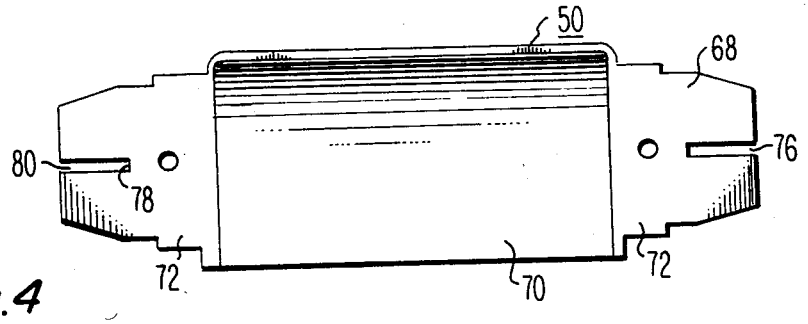
FIG. 4 is a top view of a secondary dynode used in the electron multiplier cage assembly.

Novel attachment means comprising an end tab 68 are formed in each side of the dynodes 42, 50, 52 and the anode 54. The end tab 68 is shown in FIG. 4, which provides a top view of one of the secondary dynodes 50. The dynode 50 has an active region 70 with a pair of support shoulders 72 extending from opposite sides of the active region 70, as disclosed in the above-referenced copending patent application to Kaiser. End tabs 68 project outwardly from the support shoulders 72. Each end tab 68 is designed to fit within one of a plurality of support slots 74, shown in FIG. 3, which are formed through each of the insulating support spacers 58. The end tab 68 is bifurcated so that a tab notch 76, having a closed end 78 and an open end 80, separates the end tab 68 into two portions. As shown in phantom in FIG. 2, the closed end 78 of the notch 76 is disposed within the spacers 58 to facilitate bending the end tabs 68 without damaging the spacers 58. As shown in FIG. 3, selected ones of the portions of the end tab 68 may be bent to contact the support plate 58, thereby securing the dynodes 42, 50, 52 and the anode 54 within the cage assembly 32. The portion of the end tab 68 that is not bent provides a connection to electrical leads 81 (shown in FIG. 1) which extend from a plurality of pins 82 in a tube base 84 to the dynodes and the anode of the cage assembly 32. A cathode electrical lead 86, also shown in FIG. 1, extends between a cathode contact assembly 88 and one of the pins 82 in the base 84.

When the cage assembly 32 is assembled, as described herein, the secondary dynodes 42, 50, 52 and the anode 54 have a transverse dimension, as measured across the support shoulders 72 of the secondary dynodes of about $21.84 \pm 0.05$ mm ($0.860 \pm 0.002$ inches). The minimum transverse dimension of the flaps 66 and the light shield 62 is about $22.05 \pm 0.05$ mm ($0.868 \pm 0.002$ inches). The resulting cage assembly 32 provides a slight transverse gap between the secondary dynodes 42, 50, 52 and anode 54 and the inside surfaces of the insulating support plates 58, so that no compressive force is applied to the secondary dynodes or anode which could distort the parts and cause a short between the secondary dynode mesh members 48, 56 or the anode 54 and the adjacent dynodes.

What is claimed is:

1. In a photomultiplier tube comprising an evacuated envelope having therein a photoemissive cathode, a shield cup spaced from said cathode, and an electron multiplier cage assembly abutting said shield cup, said cage assembly including a pair of transversely spaced insulating support plates having a plurality of support slots formed therethrough, each of said plates having a distal end and a proximal end, the proximal ends of said plates being attached to said shield cup, a light shield disposed between the distal end of said plates, and a plurality of dynodes and an anode disposed between said plates and attached thereto by oppositely projecting attachment means extending from the sides of said dynodes and said anode, said attachment means being disposed within said support slots of said plates, at least one of said dynodes having a field mesh attached thereto, the improvement comprising said shield cup including support plate spacing means disposed between said plates to establish a minimum transverse spacing between the proximal ends of said plates, said light shield having a transverse dimension substantially equal to that of said spacing means to establish the minimum transverse spacing between the distal ends of said plates, said spacing means and said light shield acting, in combination, to provide a uniform transverse spacing between said plates thereby preventing distortion of said field mesh by said plates, and said attachment means of said dynodes and said anode being bifurcated, one portion of selected ones of said attachment means being formed to secure said dynodes and said anode between said plates.

2. The tube as in claim 1, wherein said spacing means comprises a plurality of flaps struck from the body of said shield cup.

3. The tube as in claim 1, wherein said attachment means comprises tabs, each of said tabs having two substantially equal portions divided by a notch having a closed end and an open end.

4. The tube as in claim 3, wherein the closed end of said notch is disposed within said support slot of said insulating support plate.

5. In a photomultiplier tube comprising an evacuated envelope having a faceplate portion with an interior surface, a photoemissive cathode disposed on said interior surface for emitting photoelectrons in response to radiation incident thereon, a shield cup spaced from said cathode, and an electron multiplier cage assembly abutting said shield cup, said electron multiplier cage assembly including a pair of transversely spaced, substantially parallel insulating support plates having a plurality of support slots formed therethrough, each of said plates having a distal end and a proximal end, the proximal ends of said plates being attached to said shield cup, a light shield transversely disposed between the distal end of said plates, a primary dynode for receiving photoelectrons from said cathode and for emitting secondary electrons in response thereto, an anode, and a plurality of secondary dynodes disposed between said primary dynode and said anode for propagating and concatenating electron emission therebetween, said dynodes and said anode being disposed between said plates and attached thereto by a pair of oppositely projecting tabs extending from the sides of said dynodes and said anode, said tabs being disposed within said support slots in said plates, at least one of said secondary dynodes having a field mesh attached thereto, the improvement comprising a plurality of flaps struck from the body of said shield cup, said flaps extending between said plates to establish a minimum transverse spacing between the proximal ends thereof, said light shield having a transverse dimension substantially equal to that established by said flaps of said shield cup to establish the minimum transverse spacing between the distal ends of said plates, said flaps and said light shield acting, in combination, to provide a uniform minimum transverse spacing between said plates which is greater than the transverse dimension of said anode and said secondary dynodes, thereby preventing said field mesh on said secondary dynode from being distorted by said plates, and said tabs of said dynodes and said anode being bifurcated, one portion of selected ones of the tabs being formed to contact the outside surface of said plates to secure said dynodes and said anode therebetween.

6. The tube as in claim 5, wherein two flaps are struck from the body of said shield cup, said flaps being disposed adjacent to oppositely disposed sides of a centrally located shield cup aperture.

7. The tube as in claim 5, wherein said bifurcated tabs include two substantially equal portions divided by a notch having a closed end and an open end.

8. The tube as in claim 7, wherein the closed end of said notch is disposed within said support slots of said insulating support plates, said notch facilitating forming of said one portion of selected ones of said tabs without damage to said plates.

* * * * *